US005123932A

United States Patent [19]

Rath et al.

[11] Patent Number: 5,123,932

[45] Date of Patent: Jun. 23, 1992

[54] MOTOR FUEL COMPOSITIONS CONTAINING ALKOXYLATION PRODUCTS

[75] Inventors: Hans P. Rath, Gruenstadt; Herwig Hoffmann, Frankenthal; Volker Vogt, Wachenheim; Hans Horler, Pfungstadt; Helmut Mach, Heidelberg; Juergen Thomas, Fussgoenheim, all of Fed. Rep. of Germany

[73] Assignee: BASF Aktiengesellschaft, Ludwigshafen, Fed. Rep. of Germany

[21] Appl. No.: 520,745

[22] Filed: May 9, 1990

[30] Foreign Application Priority Data

May 19, 1989 [DE] Fed. Rep. of Germany ..... 3916365

[51] Int. Cl.[5] ..... C10L 1/02

[52] U.S. Cl. ..... 44/303; 44/304

[58] Field of Search ..... 44/303

[56] References Cited

U.S. PATENT DOCUMENTS

| | | | |
|---|---|---|---|
| 2,843,463 | 7/1958 | Yaston | 44/303 |
| 2,955,928 | 11/1960 | Smith | 44/303 |
| 3,054,666 | 10/1962 | Neblett | 44/303 |
| 3,756,793 | 9/1973 | Robinson | 44/62 |
| 3,758,282 | 9/1973 | Owen et al. | 44/69 |
| 3,859,318 | 1/1975 | Lesuer | 260/410.6 |
| 3,901,665 | 8/1975 | Polss | 44/58 |
| 4,859,210 | 8/1989 | Franz et al. | 44/53 |
| 4,922,029 | 5/1990 | Birnbach et al. | 568/616 |

FOREIGN PATENT DOCUMENTS

| | | |
|---|---|---|
| 0092256 | 10/1983 | European Pat. Off. . |
| 0277345 | 8/1988 | European Pat. Off. . |
| 0302487 | 2/1989 | European Pat. Off. . |
| 0356726 | 3/1990 | European Pat. Off. . |
| 1047525 | 12/1958 | Fed. Rep. of Germany . |
| 2129461 | 12/1971 | Fed. Rep. of Germany . |
| 2316535 | 10/1974 | Fed. Rep. of Germany . |
| 1964785 | 7/1979 | Fed. Rep. of Germany . |
| 2127468 | 7/1985 | Fed. Rep. of Germany . |
| 1317217 | 1/1963 | France . |
| 1425263 | 12/1965 | France . |
| 949707 | 2/1964 | United Kingdom . |
| 1217468 | 12/1970 | United Kingdom . |

*Primary Examiner*—Brian E. Hearn
*Assistant Examiner*—Maria Nuzzoliuo
*Attorney, Agent, or Firm*—Keil & Weinkauf

[57] ABSTRACT

Motor fuel compositions contain alkoxylation products of oxo oils or their fractions or esters thereof, which are alkoxylated with propene oxide and/or butene oxides and/or not more than minor aomunts of ethene oxide.

6 Claims, No Drawings

MOTOR FUEL COMPOSITIONS CONTAINING ALKOXYLATION PRODUCTS

The present invention relates to fuels for internal combustion engines, having improved properties and containing alkoxylation products which are obtained by reacting oxo oils, fractions of these oxo oils or carboxylic acids partially esterified with oxo oils or oxo oil fractions with alkylene oxides of 2 to 4 carbon atoms, in particular with propene oxide and/or butene oxides and/or minor amounts of ethene oxide. The present invention relates in particular to fuel compositions for gasoline engines.

It is known that, by introducing various additives into the gasoline, carburettors, injection nozzles, intake tubes and intake valves can more readily be kept clean and the emission of undesirable constituents of the exhaust gases can thus be reduced. In general, up to 2,500 mg/kg of additive packages are added to the gasoline. These packages generally consist of fuel detergents, corrosion inhibitors, antioxidants, icing inhibitors, carrier oils and solvents.

The particular object of carrier oils is to prevent jamming of the valves and to ensure better distribution of the detergents. Moreover, polyethers and esters as carrier oils are intended to reduce the increase in the octane number requirement of engines with increasing number of hours of operation and finally to establish a very low level of octane number requirement.

The use of esters as a gasoline additive has long been known and is described in, for example, German Laid-Open Applications DOS 2,129,461, DOS 1,964,785 and DOS 2,316,535 and British Patent 2,117,468. Esters of more than 35 carbon atoms have a particularly good effect especially when the alcohol component is highly branched, i.e. has been prepared by hydroxylation of oligomers of propene and butenes, in particular of n-butenes. When aromatic tri- and tetracarboxylic acids are used, the desired molecular weight can be obtained, in acceptable condensation times and at the usual cost for removal of catalyst, using relatively short-chain alcohols However, the high price of these acids, which are not readily obtainable, is a serious economic disadvantage. Much more economical is the use of aromatic dicarboxylic acids, such as phthalic acid, but in this case long-chain alcohols which are not readily obtainable are required for the preparation of effective esters. Although high condensation temperatures result in quite acceptable condensation times, processing is, however, very difficult and time-consuming.

The use of polyethers based on alkene oxides has also long been known and is described in, for example, German Laid-Open Application DOS 2,129,461. Here, alkene oxides, such as propene oxide and butene oxides, are preferred. However, only specific polyethers containing predominantly butene oxides are infinitely miscible with polyisobutene and polyisobutene derivatives. Butene oxides are, however, available only in limited amounts and the market price is correspondingly high.

It is an object of the present invention to synthesize highly effective, at least equivalent carrier oil at substantially lower costs and to overcome the disadvantages of the ester synthesis with complete esterification or polyether preparation with excess alkoxide. Surprisingly, alkoxylation products from reaction products of alkene oxides with oxo oils, oxo oil fractions and carboxylic acids partially esterified with oxo oils combine all advantages of esters and/or polyethers, and the costs of the starting materials can be dramatically reduced. The products are excellent carrier oils, some of which have a high molecular weight, with the result that up to 30% of the conventional detergents can be omitted without adversely affecting the quality of the gasoline, i.e. the maintenance of the intake and mixture-forming system in a clean state.

The present invention accordingly relates to fuel compositions which contain small amounts, for example from 0.005 to 0.2% by weight, of alkoxylation products, obtainable by reacting alkylene oxides of 2 to 4 carbon atoms, in particular propene oxide and/or butene oxides and/or minor amounts of ethene oxide with oxo oils, oxo oil fractions and carboxylic acids partially esterified with oxo oils or oxo oil fractions, wherein the oxo oils are distillation residues from the preparation of oxo alcohols of more than 8 carbon atoms and the molar ratio of the alkylene oxides to the OH groups and free carboxyl groups in the oxo oil or ester is preferably from 0.2 to 30. The amount of the alkoxides must at least be sufficiently large to alkoxylate all free carboxyl groups, i.e. a molar ratio of alkene oxide to carboxyl groups of not less than 2.

In the preparation of the alkoxylation products, preferred alkene oxides are propene oxide and butene oxides, in particular 1,2-butene oxide. However, minor amounts, for example up to 50 mol %, based on the total amount of the carboxyl and hydroxyl groups, of ethene oxide may also be incorporated, provided that the compatibility of the components of the gasoline additive packages is not adversely affected as a result. This is the case in particular in the preparation according to Example D. Here, even the use of pure ethylene oxide may be economical. The reaction with alkene oxides is carried out in a conventional manner and is described in, for example, German Patent Application P 38 26 608.3, Preparation Example 1.

The oxo oils or oxo oil fractions used are distillation residues from the preparation of oxo alcohols of more than 8 carbon atoms. The oxo alcohols on which the oxo oils are based should in particular be branched with 13, 17, 21, 25, 29 and 33 carbon atoms and should be derived from oligomers of propene and of butenes, in particular of n-butene, in order to ensure that the oxo oils are in a liquid state at room temperature. A low melting point well below 0° C. is advantageous since the oxo oil behaves substantially like its alcohol in this respect.

Particularly if they are derived from oligomers of propene or butenes, the oxo oils are mixtures containing many more than 20 compounds, only some of which are isomers. For example, the oxo oil of a dibutene contains, in addition to acids, nonanols, decanediols, diisononyl ethers, nonyl isononanoate and relatively large amounts of ether alcohols of the empirical formula $C_{19}H_{40}O_2$. The ether alcohols of the oxo oils are of the general formula $C_{2n+1}H_{4n+2}O_2$, where n is the number of carbon atoms of the oxo alcohol. These ether alcohols are probably formed by etherification of a diol with an alcohol, i.e. from decanediol and nonanol in the case of dibutene. This results in the presumed general formula of the ether alcohol:

$$\begin{array}{l} C_{n-1}H_{2n+1}-\underset{\underset{C_nH_{2n+1}-O}{|}}{CH}-CH_2OH \end{array}$$

where n has the abovementioned meaning and is as a rule from 9 to 33. These ether alcohols are generally present in amounts of 30–60% in the oxo oils and can, if required, be separated off by distillation. For economic reasons, however, it is not advisable to isolate the ether alcohols with subsequent esterification and/or etherification for the present intended use, unless this is necessary for reasons relating to quality.

Partial esterification of the oxo oils or oxo oil fractions characterized above can be carried out by conventional esterification processes using aliphatic and aromatic carboxylic acids. Suitable aliphatic carboxylic acids are isononanoic acid, succinic acid, maleic acid and adipic acid, as well as carboxylic acid mixtures, such as the dicarboxylic acid mixture from the preparation of adipic acid (mixture of adipic acid, succinic acid and glutaric acid) or the stripping acid from the oxidation of cyclohexane (mixture of adipic acid and hydroxycaproic acid). Suitable aromatic di- or tri- or tetracarboxylic acids are o-phthalic acid, isopththalic acid, terephthalic acid, trimesic acid, trimellitic acid, pyromellitic acid and benzenetetracarboxylic acid.

Esterification with anhydrides, in particular phthalic anhydride, is particularly preferred. The acids or anhydrides are added in the esterification as a rule in amounts of from 0.5 to 1.3 equivalents, based on the hydroxyl number, and are esterified using acid catalysts, such as titanic esters, or in the absence of a catalyst at from 150° to 250° C. under reduced pressure or while gassing with nitrogen. Working up by neutralization and washing is carried out by conventional methods. In a preferred embodiment, the oxo oils are preferably esterified in the presence of KOH using from 0.4 to 0.6 mole, based on the OH number, of phthalic anhydride, and the condensation is terminated at acid numbers of from 10 to 50 and the product is reacted, as described above, with alkene oxides without further KOH addition or removal of water. In this way, time-consuming and expensive neutralization and washing stages are avoided and the alkene oxide consumption is minimized.

Fuels for internal combustion engines are organic liquids which generally predominantly contain hydrocarbons and are suitable for operating gasoline engines, Wankel engines and diesel engines. In addition to fractions from crude oil processing, hydrocarbons from coal hydrogenation, alcohols of various origins and compositions and ethers, e.g. methyl tert-butyl ether, are present therein. The permissible mixtures generally have to meet national specifications in every country.

The alkoxylation products to be used according to the invention are added to the fuels in general together with fuel detergents, such as amines of oleic acid or ethylenediaminetetraacetic acid according to EP-A-6527, or polyisobutenylsuccinic acid, or polyether-polyaminecarbamates, and in particular polybuteneamines, obtained by reacting the alcohols or corresponding halogen compounds with $NH_3$, aminoethylethanolamine, dimethylaminopropylamine, triethylenetetramine or tetraethylenepentamine, as described in U.S. Pat. No. 3,275,354, DE-A-21 25 039 or European Patent 244,616, corrosion inhibitors, i.e. generally low molecular weight compounds containing amide and/or ammonium and/or amine and/or acid groups or triazole and imidazole derivatives, as well as phenolic or aminic antioxidants, such as di-tert-butylphenol or paraphenylenediamine, and finally icing inhibitors, such as alcohols or diols. The combination of the alkoxylation products to be used according to the invention with polybuteneamines is preferred, the ratio of the alkoxylation products to the polybuteneamines being as a rule from 1:2 to 3:1. A carrier oil combination with polyethers or mineral oil is also suitable; this makes it possible to reduce the proportion of the alkoxylation products relative to the polybuteneamines, polyether-polyaminecarbamates or amides.

Although the reasons for the effect of the alkoxylation products to be used are not known in detail, it may be stated that the efficiency increases with increasing viscosity. Accordingly, the lower limit for the number of carbon atoms is not clearly defined and the upper limit is determined solely by the viscosity, i.e. the handling properties, low temperature stability (melting point) and the availability of the oxo oils.

In the Examples which follow, the preparation of some typical alkoxylation products according to the invention and their effect in engines are described in comparison with known additives.

PREPARATION EXAMPLE A

The alkoxylation product is prepared using the distillation residue of a $C_9$-oxo alcohol, obtained from the cobalt-catalyzed hydroxylation of dibutene. The dibutene is prepared from raffinate II, a mixture of roughly 30% of butanes, 45% of but-1-ene and 25% of cis- and trans-but-2-ene. 5 g of KOH flakes are added to 1,000 g of this distillation residue, which has an OH number of 132, an acid number of 10, a density of 0.872 g/cm$^3$ at 20° C. and a viscosity of 27 mm$^2$/s at 20° C., in a stirred kettle, the reaction vessel is flushed with nitrogen, evacuated to 10 mbar and heated to 120° C. under reduced pressure, and the mixture is stirred for 2 hours. Under a nitrogen pressure of 1.1 bar, the mixture is heated to 160°–170° C. and 1,000 g of 1,2-butene oxide gas are introduced slowly so that a pressure of 4.5 bar is not exceeded. When gassing is complete, the pressure is allowed to reach a constant level, the pressure is let down, unconverted butene oxide distilling off, and the mixture is cooled to room temperature. The KOH is then bound by a conventional method, such as the addition of an ion exchanger, phosphoric acid or phosphate, and the precipitate is filtered off. The resulting polyether-containing mixture has an OH number of 75, a density of 0.917 g/cm$^3$ at 20° C. and a viscosity of 71 mm$^2$/s at 20° C.

PREPARATION EXAMPLE B

The procedure described in Preparation Example A is followed, except that 400 g of distillation residue, 2 g of KOH flakes and 1,600 g of 1,2-butene oxide are used. The product has an OH number of 37, a density of 0.948 g/cm$^3$ at 20° C. and a viscosity of 385 mm$^2$/s at 20° C.

PREPARATION EXAMPLE C

An ether alcohol $C_{21}H_{44}O_2$ is isolated by distillation from the distillation residue of a $C_{10}$-oxo alcohol based on trimeric propene and is reacted with a mixture of 1,2-propene oxide and 1,2-butene oxide similarly to Preparation Example A. The OH number of the alcohol is 71, its density at 20° C. is 0.87 g/cm$^3$ and its viscosity at 20° C. is 75 mm$^2$/s. 500 g of the ether alcohol, 2.5 g of KOH, 500 g of 1,2-propene oxide and 1,000 g of 1,2-butene oxide are used for the reaction. The OH number of the reaction product is 48 and its viscosity at 20° C. is 320 mm$^2$/s.

PREPARATION EXAMPLE D 75 g of a phthalic anhydride and 2 g of KOH flakes are added to 400 g of a distillation residue obtained in the synthesis of a $C_{13}$-oxo alcohol from the trimer of an n-butene mixture, as described in Preparation Example A, having a OH number of 144, an acid number of 1.5, a density at 20° C. of 0.863 g/cm$^3$ and a viscosity at 20° C. of 105 mm$^2$/s, and condensation is carried out for 5 hours at 180° C. in a stream of nitrogen. During this procedure, the acid number decreases to 20. The supply of nitrogen is stopped, the autoclave is closed and 150 g of 1,2-butene oxide gas are introduced at from 160° to 170° C. at a rate such that 4.5 bar are not exceeded. After the procedure has been continued as described in Preparation Example A and 75 g of butene oxide have been distilled off and KOH removed, a product having a density of 0.924 g/cm$^3$ at 20° C. and a viscosity of 398 mm$^2$/s at 20° C. is obtained.

The Table below shows the effect of known carrier oils and of the alkoxylation products to be used according to the invention, in combination with known detergents, in gasoline for internal combustion engines. The amounts stated in the Table were added to unleaded premium grade gasoline (research octane number 95; DIN 51,607) and were tested in test stand trials using a 1.2 l Opel Kadett engine according to CEC-F-02-T-79. The motor oil used was reference oil RL 51.

TABLE

| | Gasoline additive | | Mean intake |
|---|---|---|---|
| Trial | Type | Amount (mg/kg) | valve deposit (mg/intake valve) |
| 1 | No additive | — | 355 |
| 2 | Polybuteneamine | 250 | 42 |
| | Polyether (Polypropylene glycol, MW 2000, viscosity at 40° C. 100 m$^2$/s) | 300 | |
| 3 | Polybuteneamine | 250 | 59 |
| | Triisotridecyl phthalate | 300 | |
| 4 | Polybuteneamine | 250 | 38 |
| | Alkoxylation product of Example A | 300 | |
| 5 | Polybuteneamine | 250 | 0 |
| | Alkoxylation product of Example B | 300 | |
| 6 | Polybuteneamine | 250 | 0 |
| | Alkoxylation product of Example C | 300 | |
| 4 | Polybuteneamine | 250 | 7 |
| | Alkoxylation product of Example D | 300 | |

The Table shows that the novel alkoxylation products have a substantially better effect than the prior art, i.e. a lower level of deposits on the intake valves of the 1.2 l Opel Kadett engine.

Here, the carrier oils to be used according to the invention are combined with commercial polybuteneamine, prepared from polybutene of molecular weight 1,300 and aminoethylethanolamine (active substance content 50%). The recommended dose of the commercial polybuteneamine for formulations containing mineral oil is 350 mg/kg. In contrast, the novel carrier oils permit a saving of about 30% of polymeric detergents. Results obtained with other detergents of higher viscosity are similar.

Another advantage of the novel carrier oils is their compatibility with polyisobutene of molecular weight 800–2,000, which is present in most of the detergents used for gasoline additives. Polyethers based on propene oxide are not very compatible, i.e. relatively large amounts of solvent are required for the preparation of an additive package. Furthermore, the novel carrier oils, some of whose components are waste products or can be isolated therefrom, are substantially more economical to prepare than polyethers, especially if the latter are prepared from butene oxide, owing to compatibility with polyisobutene. Since the mixtures contain a number of low molecular weight compounds, particularly in the case of partial esterification, they are more suitable for counteracting valve sticking compared with pure polyethers having higher molecular weights.

We claim:

1. A fuel for internal combustion engines, containing fuel detergents and 0.002 to 0.2% by weight of alkoxylation products, obtained by reacting alkylene oxides of 2 to 4 carbon atoms with (a) oxo oils containing OH groups and free carboxyl groups, or (b) fractions of oxo oils containing OH groups and free carboxyl groups, or (c) carboxylic acids partially esterified with oxo oils or fractions of oxo oils, containing OH groups and free carboxyl groups, or (d) mixtures of the above wherein the oxo oils are distillation residues from the preparation of oxo alcohols of more than 8 carbon atoms, and wherein the molar ratio of the alkylene oxide to OH groups and free carboxyl groups in the ester or oxo oil is from 0.2 to 30, and the molar ratio of the alkylene oxides to the free carboxyl groups is not less than 2.

2. A fuel as claimed in claim 1, wherein the alkylene oxide is a member of the group consisting of propene oxide, butene oxide, minor amounts of ethene oxide, and mixtures thereof.

3. A fuel as claimed in claim 1, wherein the oxo oils consists of more than 50% by weight of an ether alcohol which has one ether group and one alcohol group and 2n +1 carbon atoms, where n is the number of carbon atoms of the oxo alcohol and is from 9 to 33.

4. A fuel as claimed in claim 1, wherein the oxo oils are distillation residues from the preparation of oxo alcohols from oligomers of propene and/or butenes.

5. A fuel as claimed in claim 1, wherein the oxo oils are distillation residues of oxo alcohols of oligomers of n-butene.

6. A fuel as claimed in claim 1, which contains detergents, icing inhibitors, corrosion inhibitors and antioxidants in addition to the alkoxylation products.

* * * * *